US005555752A

United States Patent [19]

Fitzpatrick

[11] Patent Number: 5,555,752

[45] Date of Patent: Sep. 17, 1996

[54] LOCK PROTECTION SYSTEM

[76] Inventor: John R. Fitzpatrick, 80 Midland St., Cold Spring Harbor, N.Y. 11724

[21] Appl. No.: 291,202

[22] Filed: Aug. 16, 1994

[51] Int. Cl.[6] ..... B65D 55/14

[52] U.S. Cl. ..... 70/159; 70/63; 70/451; 70/DIG. 30; 70/278; 200/43.22; 200/333

[58] Field of Search ..... 200/43.01, 43.13, 200/43.22, 43.04, 293, 303, 333, 341, 345; 70/277, 278, 455, 159–162, 158, 280, DIG. 30, DIG. 49, 63, 14, 58, 57, 379 R, 379 A, 232, 448, 451, 452

[56] References Cited

U.S. PATENT DOCUMENTS

| | | | |
|---|---|---|---|
| 446,246 | 2/1891 | Beebe | 70/448 |
| 1,620,474 | 3/1927 | Krick . | |
| 1,957,271 | 5/1934 | Keil . | |
| 2,623,689 | 12/1952 | Barlick . | |
| 2,655,806 | 10/1953 | Stiler | 70/57 |
| 3,096,409 | 7/1963 | Hubbell et al. | 70/232 |
| 3,146,739 | 9/1964 | Furman | 109/52 |
| 3,247,337 | 4/1966 | Wiegel | 200/43.22 |
| 3,903,721 | 9/1975 | Aaron . | |
| 4,094,177 | 6/1978 | Wellekens . | |
| 4,166,202 | 8/1979 | Reiter | 200/43.13 |
| 4,350,032 | 9/1982 | Kochackis . | |
| 4,992,635 | 2/1991 | Westcott | 200/293 |
| 5,103,659 | 4/1992 | Benefield, Sr. . | |
| 5,195,342 | 3/1993 | Werner . | |
| 5,267,688 | 12/1993 | Benefield . | |
| 5,307,653 | 5/1994 | Davis . | |

FOREIGN PATENT DOCUMENTS

| | | | |
|---|---|---|---|
| 1054647 | 5/1979 | Canada | 70/278 |
| 8502054 | 5/1985 | WIPO | 200/43.01 |

*Primary Examiner*—Darnell M. Boucher
*Attorney, Agent, or Firm*—Nolte, Nolte and Hunter, P.C.

[57] ABSTRACT

A key actuated lock is mounted within a protective enclosure which has a double hinged panel cover that projects into a slot between the bottom panel of the protective enclosure and the bottom of the lock mounted within the protective enclosure when the double hinged panel cover is closed. Both the protective enclosure and the double hinged panel cover have apertures that align when the double hinged panel cover is closed. Actuation of the lock within the protective enclosure moves a locking bolt from a unlocked retracted position to a locked extended position that projects the locking bolt through the two aligned apertures, thereby holding the double hinged panel cover closed.

7 Claims, 3 Drawing Sheets

LOCK PROTECTION SYSTEM

FIELD OF THE INVENTION

This invention relates to a protective enclosure for locks. More particularly, the invention relates to a protective housing for postal locks that protects postal locks against unauthorized access while simultaneously allowing postal employees access to a multiple dwelling residences to deliver mail. The invention contemplates its adaption to security systems other than accessing residences.

BACKGROUND OF THE INVENTION

The delivery of mail to multiple dwelling residences and other buildings requires a postal employee to use postal locks which are actuated by a key and are keyed alike so as to allow the postal employee access to all the postal locks on his or her route.

In the usual installation, the postal lock is located in a box behind a lid which faces the outside of the multiple dwelling residence or other building. Turning the key, slides the locking bolt of the postal lock to the retracted position and permits the lid to be opened, where a switch to open the door to a multiple dwelling residence or other building is located. In other instances, the box contains a key on a chain which is used to operate the lock which opens the building entrance door.

These various constructions give rise to vandalism and to the taking of keys and postal key locks from the box. A key could be made and a thief could then gain access to the various buildings on the postal worker's route.

The prior art solution to this problem was to have the key actuated postal lock on the inside of the building with the key slot accessible by an aperture through a steel plate from the outside of the building rather than through a lid which opened outwardly. The key would then be inserted from the outside through the aperture into the lock on the inside which was bolted to a plate inside. The movement of the bolt, actuated by the key, triggered a switch releasing the bolt to the building door lock. The inside postal lock was disposed in a housing with a panel door. Unfortunately, this left the postal key lock available to residents, employees, and others who gained entry to the building and who could then open the panel gaining access to the postal lock.

It is a specific object therefore of the invention to protect a postal lock against unauthorized access, while simultaneously allowing a postal employee access to multiple dwelling residences and other buildings to deliver mail. Furthermore, it is a broader object of the invention to provide such protection for other security systems operable via a lock/release element in a protective enclosure.

SUMMARY OF THE INVENTION

The present invention, in the first instance, proposes a protective enclosure which protects key actuated locks against unauthorized access, while simultaneously providing postal employees access to multiple dwelling residences and other buildings to deliver mail.

The present invention comprises a lock mounted within a protective enclosure having a back end and an open front end and which has a double hinged panel comprising a cover panel hinged to the top edge of the open end of the enclosure and a locking panel hinged to the free end of the cover panel and which is pivotable toward the inner side of the front panel so that when the double hinged panel is moved to the closed position, the locking panel is pivoted out of the arc of travel of the free end of the cover panel to avoid striking the bottom edges of the open end of the enclosure and to enter into a slot between the bottom of the protective enclosure and the bottom of the lock within the protective enclosure when the double hinged panel cover is closed. The fit of the locking panel against the bottom of the protective enclosure is close to eliminate attempts to jimmy between the bottom and the locking panel.

Both the bottom of the protective enclosure and the locking panel of the double hinged panel have apertures that align when the double hinged panel cover is closed. Actuation of the lock moves a locking bolt from an unlocked retracted position to a locked extended position that projects the locking bolt through the two aligned apertures, thereby holding the cover closed. The lock is secured against unauthorized access because the locking panel is enclosed in the protective enclosure where it cannot be jimmied or pried, or the lock's retaining nuts or screws removed.

In one embodiment of the invention, the bottom of the protective enclosure is fitted with a bracket upon which an electrical switch is mounted. The switch is operated through the movement of a spring mounted contact pin which in turn is operated by the locking bolt moving to and from the locked position extending through the aligned apertures in the bottom of the protective enclosure and the locking panel of the double hinged door panel. The switch, operated by the locking bolt is in circuit with a release solenoid which releases the bolt to the building entrance door lock when the locking bolt of the postal lock is retracted to the unlocked position and the contact pin is moved by the action of a spring to close (or open) the circuit.

When the postal employee turns the key actuated lock back toward the locked position, the locking bolt once again extends through the aligned apertures to effectively close the protective enclosure and prevent unauthorized access to the key actuated lock and at the same time to depress the contact pin which opens (or closes) the circuit to the release solenoid to maintain the bolt of the building entrance door lock in the locked position.

It is an object of the present invention to provide a protective enclosure for locks to be used in conjunction with an electrical switch system which is activated when the locking bolt is retracted. The electrical switch used in conjunction with the protective enclosure can be used to control key actuated locks, and the like to allow authorized persons access to residences, and other buildings, while simultaneously denying unauthorized individuals access to the locks. The switch may also be used to control electronic locks, automated doors, security alarms, by-pass controls and access controls for a variety of security functions.

Other objects and advantages of the present invention will be further described in following drawings and description of the preferred embodiment.

DESCRIPTION OF THE PREFERRED EMBODIMENT

Figure 3:
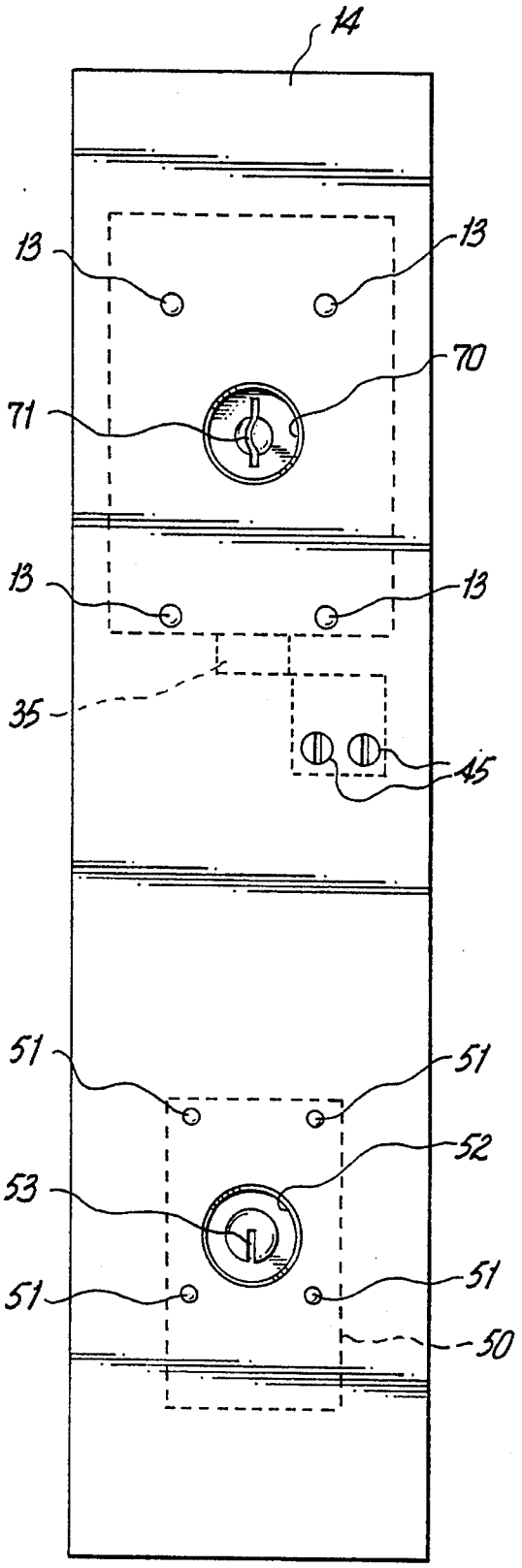
FIG. 3 is a diagrammatic front elevational view of the street side of the apparatus of FIGS. 1–2.
Figure 4:
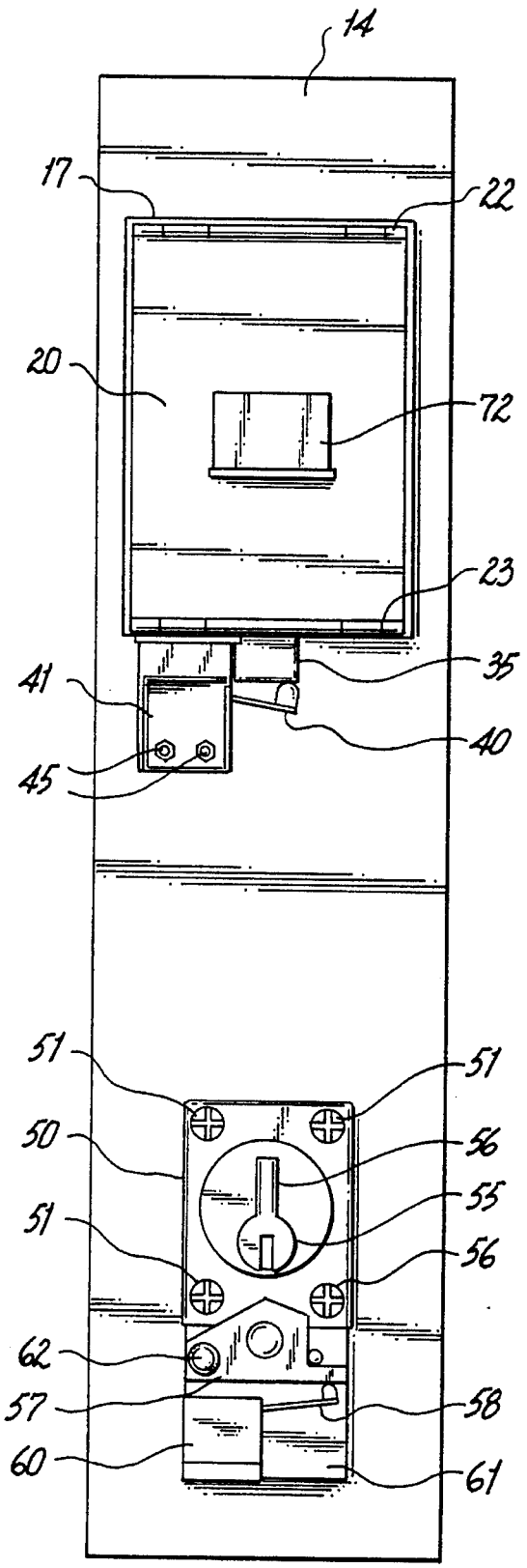
FIG. 4 is diagrammatic rear elevational view of the inner side of the apparatus of FIGS. 1–3.

The figures shows key actuated postal lock 10 mounted within a metal protective enclosure 11 by nuts 12 threaded on the inner ends of bolts 13. The metal protective enclosure 11 is mounted against a metal door style in the form of plate 14 by the metal mounting bolts which extend through the corners of the lock and back wall 15 of the enclosure and through the style where they are machined flush to the front face of the metal style plate 14 as shown in FIG. 3. The locking mechanism of the postal lock is accessed by a key, not shown, inserted through key aperture 70 in plate 14 into keyway 71. When the key is turned the bolt 35 of the lock is moved to and from its extended and retracted position.

The metal protective enclosure 11 comprises the back wall 15, side walls 16 and upper and lower walls 17, 18 and double hinged panel cover 19. The double panel cover 19 comprising cover panel 20 and locking panel 21 is affixed to the metal protective housing 11 by means of hinge 22 pivotally connecting the cover panel to upper wall 17. The locking panel 21 is affixed to the free end of cover 20 by means of a second hinge 23. Cover panel 20 has a pull tab 72 to open double hinged panel cover 19.

Figure 1:
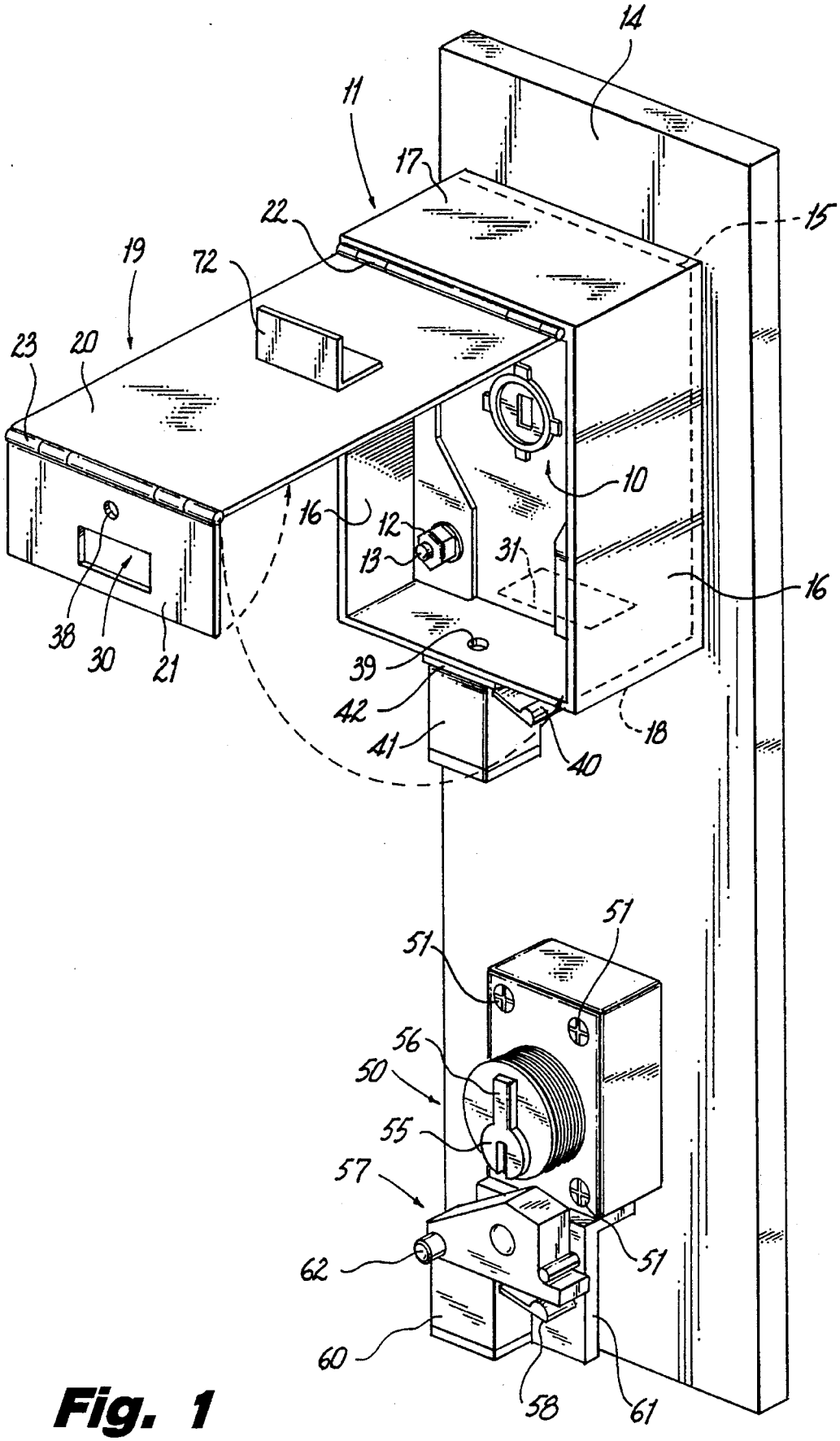
FIG. 1 is a diagrammatic frontal isomeric view of a postal lock and protective enclosure of the present invention mounted on a door style of a residence or building entrance door.
Figure 2:
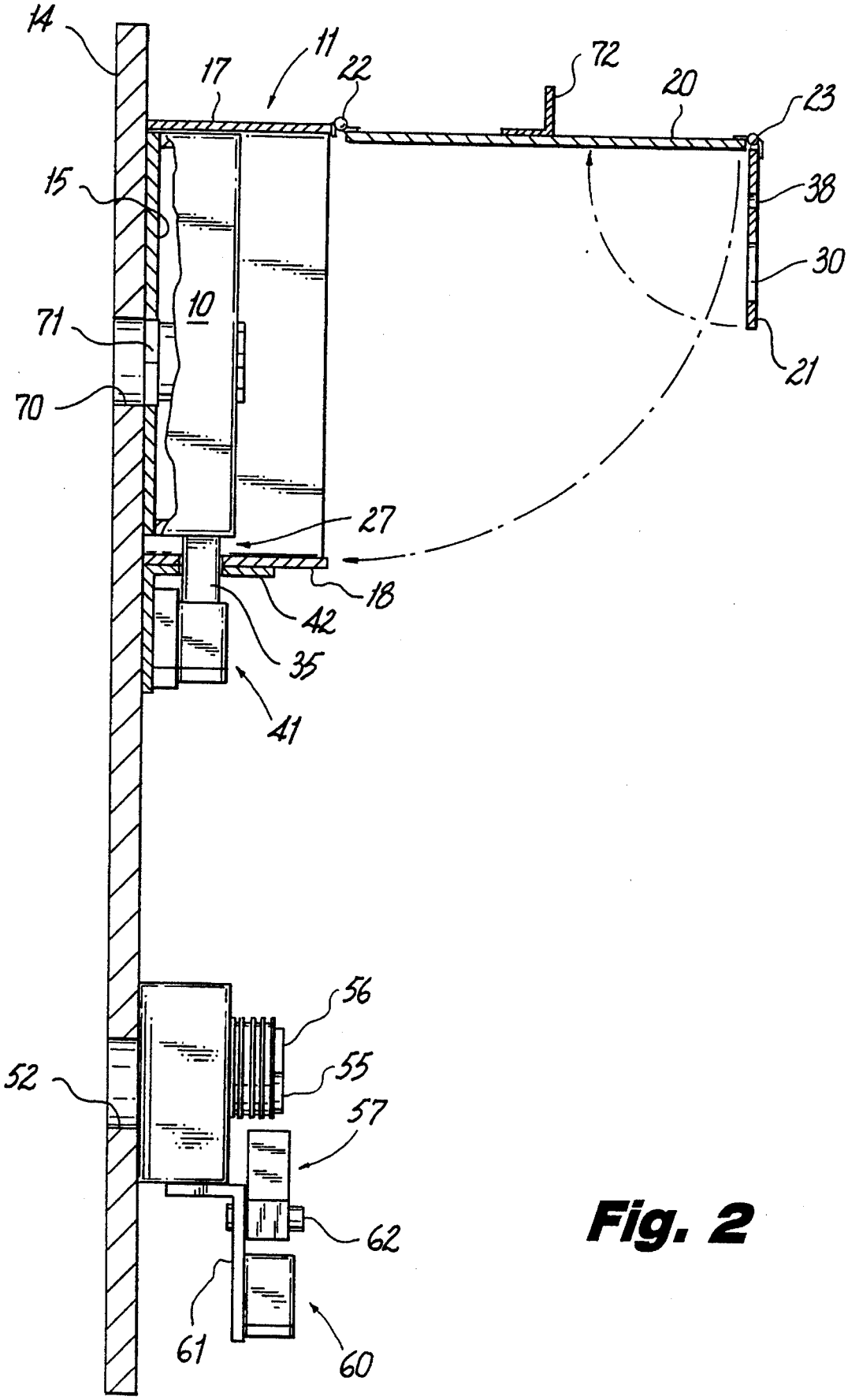
FIG. 2 is a diagrammatic sectional view taken generally along the vertical axis of the apparatus of FIG. 1.

The cover panel of double hinged panel cover 19 when in the closed position, closes the opening of the enclosure and covers the key actuated postal lock while the locking panel extends within the metal protective enclosure inserted in the slot like space 27 (FIG. 2) between the lower wall 18 of the metal protective enclosure and the bottom of the key actuated postal lock 10. The locking panel is hinged to the cover panel so that it may be pivoted out of the way of the lower edge of the enclosure front opening as the cover panel is swung to the closed position and assume a close adjacency with the lower wall 18 to discourage, if not eliminate jimmying between the lower wall and locking panel.

Both the hinged locking panel as well as the bottom wall of the metal protective enclosure have rectangular apertures 30 and 31 that align when the locking panel extends into the protective enclosure to allow the locking bolt 35 (FIG. 2) to extend through both apertures when the key actuated postal lock is in the locked position with the locking bolt extended.

Moreover, the hinged locking panel as well as the bottom wall of the metal protective enclosure have additional circular apertures 38 and 39 that align when the locking panel extends into the metal protective enclosure. The aperture in the locking panel is threaded so that when both apertures 38 and 39 are aligned, a threaded bolt can screwed into both apertures to provide in-place stability to the double hinged panel cover when in the closed position with the locking bolt retracted.

A switch 41 is mounted on a bracket 42 underneath the metal protective closure by nut and bolt fasteners 45. When the locking bolt 35 extends through the two aligned rectangular apertures 38, 31, it depresses a contact pin 40 which operates an electrical switch 41 to open a circuit in which a solenoid (not shown) is operative to maintain the bolt (not shown) to the building lock 50 in the extended position. When the locking bolt 35 is retracted, the contact pin 40 is biased upwardly to operate switch 41 to close (or open) the circuit to operate the solenoid to release the residential door bolt so that it can be retracted.

The building entrance door lock 50 mounted on the stile 14 below the protective enclosure by flush bolts 51 is accessed by a key, not shown, inserted through stile aperture 52 to keyway 53 which turns barrel 55 and cam follower 56 which depresses cam 57 and contact pin 58 to operate switch 60 to close the circuit to operate the solenoid to release the bolt of the door lock. The cam 57 is secured to bracket 61 mounted to the underside of door lock 50 by bolt 62.

It should be understood that the above description discloses the specific embodiment of the present invention and is for the purpose of illustration only. There may be other modifications and changes obvious to those of ordinary skill in the art which fall within the scope of the present invention which should be limited only by the following claims and there legal equivalents.

What is claimed is:

1. A security housing having a plurality of walls forming a closed box having a first wall of said plurality of walls hingedly attached to a second wall of said plurality of walls by first hinge means on a first end of said first wall of said plurality of walls so that said first wall is rotatable from a first position in which the box is closed to a second position in which the box is opened, the second and remaining of said plurality of walls forming said closed box being rigidly joined with one another in fixed relationship, said closed box comprising a wall formed with a first lock bolt receiving aperture, a panel comprising a second lock bolt receiving aperture in said panel, said panel being hingedly attached to a second end of said first wall of said plurality of walls so that said panel can be rotated toward and away from said first wall and can be extended into and enclosed in said closed box to prevent jimmying or prying of said panel and so that the first and second lock bolt receiving apertures are in alignment one behind the other when said first wall of said plurality of walls is in the first position.

2. The security housing of claim 1 further comprising:

a lock having a keyway and a movable bolt, said lock being mounted in said closed box fixedly within said closed box so that said keyway is accessible by way of a third aperture formed through one of the rigidly joined walls and said movable bolt is movable from a retracted position within said closed box to and from an extended locking position extending through said first and second aligned apertures.

3. The security housing of claim 2, further comprising:

said first lock bolt receiving aperture being in one of the rigidly joined walls adjacent to the rigidly joined wall having said third aperture so that when said bolt is extended said bolt extends through said panel, through a rigidly joined wall of said closed box, and outside said box, and said panel being in close juxtaposition to the rigidly joined wall having the first aperture, so that said panel cannot be removed from said closed box by jimmying between said panel and the rigidly joined wall having the first aperture.

4. The security housing of claim 3 further comprising:

said security housing being in combination with a door stile, the box being mounted on the inside of said door stile and said stile being formed with an aperture communicating with said key way, a second lock mounted on said door stile, said second lock comprising means for operating an electrical solenoid, an electrical switch mounted adjacent said first and second apertures in fixed spatial relation to said first lock, said switch including means moveable by said bolt when said bolt is moved between retracted and extended positions for opening and closing an electrical circuit.

5. The security housing of claim 3, further comprising:

a fourth threaded aperture in said panel, and a fifth aperture in the rigidly joined wall having said first lock bolt receiving aperture, said fourth aperture and fifth apertures being in alignment when said first and second apertures are in alignment, said fifth aperture being larger in diameter than the threads of said fourth threaded aperture.

6. The security housing of claim 2 wherein said lock is fixedly mounted in said housing by mounting means accessible only when said bolt is in the retracted position and said first wall is in the second position in which said box is opened, said bolt being movable to and from said extended locking position by movement of said keyway by a separable key.

7. The security housing of claim 3 wherein said lock is fixedly mounted in said housing by mounting means accessible only when said bolt is in the retracted position and said first wall is in the second position in which said box is opened, said bolt being movable to and from said extended locking position by movement of said keyway by a separable key.

* * * * *